US006934483B2

(12) United States Patent
Tatematsu et al.

(10) Patent No.: US 6,934,483 B2
(45) Date of Patent: Aug. 23, 2005

(54) IMAGE HEATING DEVICE, IMAGE FORMING APPARATUS, IMAGE COPYING MACHINE, AND METHOD FOR CONTROLLING TEMPERATURE

(75) Inventors: Hideki Tatematsu, Ashiya (JP); Kenji Asakura, Kyoto (JP); Masaru Imai, Hirakata (JP); Tadafumi Shimizu, Ogoori (JP); Masahiro Samei, Fukuoka (JP); Keiichi Matsuzaki, Kurume (JP); Kazunori Matsuo, Oonojo (JP); Shoichi Kitagawa, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/374,541

(22) Filed: Feb. 25, 2003

(65) Prior Publication Data

US 2003/0161650 A1 Aug. 28, 2003

(30) Foreign Application Priority Data

Feb. 28, 2002 (JP) ..... 2002-053134

(51) Int. Cl.[7] ..... G03G 15/20
(52) U.S. Cl. ..... 399/69; 399/67
(58) Field of Search ..... 399/67–69, 320, 399/328, 329, 330, 332, 337

(56) References Cited

U.S. PATENT DOCUMENTS 5,436,430 A * 7/1995 Baruch et al. ..... 219/216
5,464,964 A * 11/1995 Okuda et al. ..... 219/497
5,579,098 A * 11/1996 Noguchi et al. ..... 399/122
5,839,042 A * 11/1998 Tomatsu ..... 399/328
6,018,140 A * 1/2000 Hirose et al. ..... 219/216
6,021,303 A * 2/2000 Terada et al. ..... 399/328
6,141,511 A * 10/2000 Nakayama ..... 399/69
6,175,699 B1 * 1/2001 Kato et al. ..... 399/69
6,181,890 B1 * 1/2001 Kataoka et al. ..... 399/67
6,298,215 B1 * 10/2001 Nomura et al. ..... 399/328
6,321,047 B1 11/2001 Takata
6,438,348 B2 * 8/2002 Kobaru et al.
6,671,470 B2 * 12/2003 Suzuki et al. ..... 399/69

FOREIGN PATENT DOCUMENTS

| | | | | |
|---|---|---|---|---|
| EP | 0436955 | | 7/1991 | |
| EP | 0436955 | A2 * | 7/1991 | ..... G03G/15/20 |
| JP | 6-149102 | | 5/1994 | |
| JP | 7-121050 | | 5/1995 | |
| JP | 9-230738 | | 9/1997 | |
| JP | 09230738 | A * | 9/1997 | ..... G03G/15/20 |
| JP | 9-297486 | | 11/1997 | |
| JP | 9-325643 | | 12/1997 | |
| JP | 09325643 | A * | 12/1997 | ..... G03G/15/20 |
| JP | 2000-66541 | | 3/2000 | |
| JP | 2000147852 | A * | 5/2000 | ..... G03G/15/00 |
| JP | 2000-250338 | | 9/2000 | |
| JP | 2001-66944 | | 3/2001 | |
| JP | 2001-100588 | | 4/2001 | |

* cited by examiner

*Primary Examiner*—Arthur T. Grimley
*Assistant Examiner*—Ryan Gleitz
(74) *Attorney, Agent, or Firm*—Hamre, Schumann, Mueller & Larson, P.C.

(57) ABSTRACT

A fixing device as an image heating device is provided, by which a difference in glossiness is not caused in a recording medium in the axial direction of a pressure roller. When a print request is issued during the end-processing sequence, an electric power applied to a magnetization coil via an exciting circuit is dropped to 0 by controlling means during the start-processing sequence, and after an appropriate interval, the heating with full power is restarted by the controlling means. By so doing, the decrease in temperature at both ends of a fixing belt and a heat-generating roller in the axial direction can be compensated.

20 Claims, 9 Drawing Sheets

| | Sheet | Letter | A4 | Legal | B5 |
|---|---|---|---|---|---|
| | Length of sheet | 279 | 297 | 356 | 257 |
| Length of each phase | Phase (1) | 94 | 94 | 94 | 94 |
| | Phase (2) | 94 | 94 | 94 | 94 |
| | Phase (3) | 91 | 94 | 94 | 69 |
| | Phase (4) | | 15 | 74 | |

| | Temperature of pressure roller | Low temperature | High temperature |
|---|---|---|---|
| | temperature of fixing belt | 70°C or lower | 71°C or higher |
| Control temperature | Phase (1) | 0 deg | 0 deg |
| | Phase (2) | 1 deg | 1 deg |
| | Phase (3) | 2 deg | 1.5 deg |
| | Phase (4) | 3 deg | 1.5 deg |

IMAGE HEATING DEVICE, IMAGE FORMING APPARATUS, IMAGE COPYING MACHINE, AND METHOD FOR CONTROLLING TEMPERATURE

BACKGROUND OF THE INVENTION

1. Field of the Invention

The present invention relates to an image heating device that is suitable as a fixing device for fixing an unfixed toner image by heating a conductive belt directly or indirectly via a metal roller utilizing electromagnetic induction; an image forming apparatus, such as an electrophotographical apparatus or an electrostatic recording apparatus, using such an image heating device; an image copying machine using such an image forming apparatus; and a method for controlling temperature applicable to such an image heating device, an image forming apparatus, and an image copying machine.

2. Description of the Related Art

As image heating devices typically used for fixing devices, contact-heating type image heating devices such as roller-heating type devices and belt-heating type devices generally have been used.

In recent years, due to the demand for shorter warm-up time and reduced energy consumption, electromagnetic induction heating, by which rapid heating and high efficiency heating are likely to be attained, are attracting great attention. In the belt-heating type image heating devices, to shorten the warm-up time, a conductive belt having a smaller thermal capacity is used. A high-frequency current is applied to a magnetization coil to generate a high-frequency magnetic field, which causes an induced eddy current to be generated in the conductive belt, thereby causing Joule heat to be generated in the conductive belt itself. An unfixed toner image formed on a recording medium (paper, an OHP film, etc.) can be fixed after passing through a nip portion formed between a fixing roller and a pressure roller, which are pressed against with each other via the conductive belt that generates heat.

On the other hand, in the roller-heating type image heating devices, to shorten the warm-up time, a metal roller having a smaller thickness is used. A high-frequency current is applied to a magnetization coil to generate a high-frequency magnetic field, which causes an induced eddy current to be generated in the metal roller, thereby causing Joule heat to be generated in the metal roller. An unfixed toner image formed on a recording medium (paper, an OHP film, etc.) can be fixed after passing through a nip portion formed between the metal roller and the opposing pressure roller or between a fixing roller, to which heat conducted from the metal roller is transferred via a heat-resistant resin belt, and the opposing pressure roller.

In belt-type image heating devices (devices using a conductive belt or resin belt), a conductive belt having a small thermal capacity is heated through electromagnetic induction (direct heating of the belt), or a metal roller is heated through electromagnetic induction and the heat generated by the roller is conducted to a resin belt having a small thermal capacity (indirect heating of the belt). Thus, although the belt itself can be heated rapidly, a pressure roller having a large thermal capacity is heated slowly. Accordingly, in an early stage of the device operation, the temperature of the pressure roller is not sufficiently high while the belt already has reached a fixing temperature.

Even if the temperature of the pressure roller increases gradually with the temperature rise of the belt and reaches a desired fixing temperature afterward, a recording medium removes the heat from the pressure roller when passing through the nip portion. Consequently, glossiness decreases from the leading end toward the trailing end of the recording medium in the direction in which the recording medium is fed (hereinafter, referred to as "feed direction"), resulting in fixing failure in the worst case (irregularity in gloss in the feed direction).

By the way, if a new print request is issued after printing is started and before the formation of an electrostatic latent image by exposing means is completed, a print-processing sequence for forming another electrostatic latent image by the exposing means is executed continuously (continuous print mode). In this continuous print mode, as shown in FIG. 7A, a recording medium is fed when the necessary fixing temperature is maintained, similarly to the case where printing is performed on a plurality of recording media, and the heat is conducted to the recording medium from a paper feed portion at the center of the fixing belt and the pressure roller in the axial direction. In the fixing belt with a small thermal capacity, the temperature is liable to decrease from the end portions. However, an irregularity in temperature is not caused in the fixing belt because the difference in temperature between the end portions and the center whose temperature is decreased by the printing is small and the end portions are heated by a heat source by applying an electric power of, for example, about 500 W to compensate the temperature decrease.

However, in the case where a new print request is issued after the formation of an electrostatic latent image by the exposing means is completed and before paper ejection is completed, a print-start-processing sequence is executed immediately after a print-end-processing sequence is executed (semicontinuous print mode). In this semicontinuous print mode, as shown in FIG. 7B, the image heating device starts a temperature-maintaining operation, in which only a small electric power of, for example, about 300 W is used, immediately after the print-end-processing sequence is executed. As a result, an amount of the heat released from the fixing roller and the heat-generating roller becomes relatively large so that the temperature decreases at both ends of the fixing roller and the heat-generating roller in the axial direction. Thus, glossiness decreases at both ends of the recording medium in the axial direction of the heat-generating roller, resulting in fixing failure in the worst case (irregularity in gloss in the axial direction).

SUMMARY OF THE INVENTION

The present invention has been made in light of the above-described problems in the prior art. It is an object of the present invention to provide an image heating device by which a difference in glossiness is not caused in a recording medium either in the feed direction of the recording medium or in the axial direction of a pressure roller; an image forming apparatus using such an image heating device; an image copying machine using such an image forming apparatus; and a method for controlling temperature applicable to such an image heating device, an image forming apparatus, and an image copying machine.

To achieve the above-described object, an image heating device according to the present invention includes: a movable heating member (belt) for directly heating a material to be heated (a recording sheet, an OHP film, etc.); heat-generating means for directly or indirectly heating the heating member; pressing means arranged in contact with the heating member; a temperature sensor for detecting a temperature of the heating member; and controlling means for controlling an amount of heat generated by the heat-generating means according to the temperature of the heating member detected by the temperature sensor so that the heating member has a set temperature. The controlling means stops the heating of the heating member by the heat-generating means for a while when a new print request is issued during printing and restarts the heating of the heating member by the heat-generating means during subsequent printing performed in response to the new print request.

With the foregoing configuration of the image heating device, the decrease in glossiness at both ends of the material to be heated in the axial direction of the pressing means (pressure roller) can be prevented.

In the image heating device according to the present invention, the heating member is at least partially conductive (conductive belt), and the heat-generating means includes magnetization means that directly heats the heating member through electromagnetic induction. Alternatively, the heat-generating means includes a rotatable heat-generating member (for example, a metal roller) for indirectly heating the heating member (for example, a heat-resistant resin belt) that is at least partially conductive and arranged in contact with an inner peripheral surface of the heating member, and magnetization means that heats the heating member through electromagnetic induction.

Furthermore, in the image heating device according to the present invention, the heating member (belt) preferably has a thermal capacity of not more than 60 J/K, further preferably not more than 40 J/K.

In the case where the thermal capacity of the belt is set to be not more than 60 J/K, it is estimated that the heating of the belt by the heat-generating means with an applied electric power of 1000 W causes only one tenth or less of the belt to be heated actually in a static state, thereby raising the temperature of the belt up to 200° C. or above within a short time of approximately one second. Furthermore, in the case where the thermal capacity of the belt is set to be not more than 40 J/K, the heating of the belt by the heat-generating means with an applied electric power of 900 W raises the temperature of the belt up to several hundreds of degrees Celsius or above within a short time of approximately one second.

Furthermore, in the image heating device according to the present invention, it is preferable that the controlling means stops the heating of the heating member by the heat-generating means for a while also when a new print request is issued within a predetermined period after completion of printing and restarts the heating of the heating member by the heat-generating means during subsequent printing performed in response to the new print request.

With the foregoing configuration, the decrease in glossiness at both ends of the material to be heated in the axial direction of the pressing means can be prevented also in the case where a new print request is issued within a predetermined period after the completion of printing.

The image heating device according to the present invention preferably includes a cover for covering a space occupied by at least a part of the heating member (belt), the temperature sensor, and the pressing means (pressure roller) excluding a path portion through which the material to be heated passes, so as to make the temperature of the heating member detected by the temperature sensor substantially coincide with an ambient temperature in the vicinity of the temperature sensor.

This configuration makes the detected temperature of the belt coincide with the ambient temperature, thereby preventing the temperature of the pressure roller from rising to above the temperature of the belt. Thus, it is possible to estimate the temperature of the pressure roller appropriately.

Still further, in an image heating device according to the present invention, it is preferable that the pressing means is in a roller form and that the controlling means independently determines set temperatures of parts of the heating member for heating parts of the material to be heated, which are defined by dividing the material from its leading end with a pitch corresponding to a length of a roller outer periphery of the pressing means, respectively.

According to this configuration, the decrease in glossiness occurring from the leading end toward the trailing end of the material to be heated in the feed direction can be prevented.

Still further, in the image heating device according to the present invention, it is preferable that the controlling means determines the set temperatures of the parts of the heating member based on a temperature of the pressing means. In this case, it is preferable that the temperature of the pressing means is estimated according to at least one of a temperature of the heating member detected by the temperature sensor and a variation with time in the detected temperature.

The temperature of the pressing means (pressure roller) cannot be higher than that of the belt. Therefore, when the detected temperature of the belt is lower than a predetermined temperature (e.g., 120° C.), it is considered that the temperature of the pressure roller also is lower than the predetermined temperature. However, when the detected temperature of the belt is at or higher than the predetermined temperature (e.g., 120° C.), the temperature of the pressure roller may be higher or lower than the predetermined temperature.

Thus, regarding the predetermined temperature as a threshold temperature, when the detected temperature of the belt is not higher than 120° C., it is estimated that the temperature of the pressure roller is low, based on the temperature of the belt detected immediately before the start of subsequent image heating. Thus, the set temperature is determined according to a look-up table for intermediate temperature (e.g., 71° C. to 120° C.) or a look-up table for low temperature (e.g., 70° C. or lower).

On the other hand, when the detected temperature of the belt is higher than 120° C., a set temperature is determined in the following manner.

When a variation with time in the detected temperature of the belt in the time elapsing from the instant when the proceeding image heating is completed to the instant immediately before the start of subsequent image heating is small, in other words, when the detected temperature of the belt during the elapsed time is higher than the cooling curve of the belt (threshold temperature), which is represented as an equation having the elapsed time as a parameter and set in advance, it is estimated that the temperature of the pressure roller is high and the set temperature is determined according to a look-up table for high temperature (e.g., 120° C. or higher). On the other hand, when a variation with time in the detected temperature of the belt with respect to the elapsed time is large, in other words, the detected temperature of the belt during the elapsed time is lower than the cooling curve of the belt (threshold temperature), it is estimated that the temperature of the pressure roller is low and the set temperature is determined according to a look-up table for intermediate temperature.

As described above, by selecting an optimal look-up table based on the degree of the cooling of the belt, the temperature of the pressure roller can be estimated from the temperature or a variation in the temperature of the belt without providing a temperature sensor for the pressure roller, thereby making it possible to set an optimal fixing temperature.

To achieve the above-described object, a first image forming apparatus according to the present invention includes image forming means for forming an unfixed toner image onto a recording medium as an material to be heated and having the unfixed image carried thereon, and a fixing device for thermally fixing the toner image onto the recording medium, wherein the fixing device is an image heating device according to the present invention.

With the foregoing configuration of the first image forming apparatus, it is possible to provide an image forming apparatus such as an electrophotographic device or an electrostatic recording device having the advantage of the image heating device according to the present invention. In this configuration, the cover for making the detected temperature of the heating member substantially coincide with the ambient temperature in the vicinity of the temperature sensor is provided on the image heating device.

To achieve the above-described object, a second image forming apparatus according to the present invention includes image forming means for forming an unfixed toner image according to the original image onto a recording medium as a material to be heated and having the unfixed image carried thereon, and a removable fixing device for thermally fixing the toner image onto the recording medium, wherein the fixing device is an image heating device according to the present invention that does not have a cover. The image forming apparatus further includes a cover for covering a space occupied by at least a part of the heating member (belt), the temperature sensor, and the pressing means (pressure roller) excluding a path portion through which the material to be heated passes when the fixing device is attached, so as to make the temperature of the heating member detected by the temperature sensor substantially coincide with an ambient temperature in the vicinity of the temperature sensor.

With the foregoing configuration of the second image forming apparatus, it is possible to provide an image forming apparatus such as an electrophotographic device or an electrostatic recording device having the advantage of an image heating device according to the present invention. In this configuration, the cover for making the detected temperature of the heating member substantially coincide with the ambient temperature in the vicinity of the temperature sensor is provided on the image forming apparatus in a state in which the image heating device is detached therefrom.

To achieve the above-described object, an image copying machine according to the present invention includes an image reading apparatus that includes image reading means for reading an original image, and the first or second image forming apparatus that thermally fixes and forms a toner image according to the original image read by the image reading apparatus onto a recording medium.

To achieve the above-described object, a first temperature controlling method according to the present invention is applicable to an image heating device that includes: a movable heating member (belt) for directly heating the material to be heated (a recording sheet, an OHP film, etc.); heat-generating means for directly or indirectly heating the heating member; pressing means arranged in contact with the heating member; a temperature sensor for detecting a temperature of the heating member; controlling means for controlling an amount of heat generated by the heat-generating means according to the temperature detected by the temperature sensor so that the heating member has a set temperature; and a cover for covering a space occupied by at least a part of the heating member (belt), the temperature sensor, and the pressing means (pressure roller) excluding a path portion through which the material to be heated passes, so as to make the temperature of the heating member detected by the temperature sensor substantially coincide with an ambient temperature in the vicinity of the temperature sensor. The method includes the steps of stopping the heating of the heating member by the heat-generating means for a while when a new print request is issued during printing; and restarting the heating of the heating member by the heat-generating means during subsequent printing performed in response to the new print request.

In the first temperature controlling method, it is preferable that the pressing means is in a roller form, and that the method further includes the steps of: independently determining set temperatures of parts of the heating member for heating parts of the material to be heated, which are defined by dividing the material from its leading end with a pitch corresponding to a length of an outer periphery of the pressure roller, respectively; and controlling the amount of the heat generated by the heat-generating means so that the parts of the heating member have the set temperatures determined in the determining step.

With the foregoing configuration of the first temperature controlling method, it is possible to realize a temperature controlling method suitable for an image heating device according to the present invention having a cover.

To achieve the above-described object, a second temperature controlling method according to the present invention is applicable to an image forming apparatus that includes: image forming means for forming an unfixed toner image onto a recording medium as a material to be heated and having the unfixed image carried thereon; a removable image heating device for thermally fixing the toner image onto the recording medium (a recording sheet, an OHP film, etc.), the image heating device including: a movable heating member (belt) for directly heating the material to be heated; heat-generating means for directly or indirectly heating the heating member; pressing means arranged in contact with the heating member; a temperature sensor for detecting a temperature of the heating member; and controlling means for controlling an amount of heat generated by the heat-generating means according to the temperature detected by the temperature sensor so that the heating member has a set temperature; and a cover for covering a space occupied by at least a part of the heating member (belt), the temperature sensor, and the pressing means (pressure roller) excluding a path portion through which the material to be heated passes when the fixing device is attached, so as to make the temperature of the heating member detected by the temperature sensor substantially coincide with an ambient temperature in the vicinity of the temperature sensor. The method includes the steps of: stopping the heating of the heating member by the heat-generating means for a while when a new print request is issued during printing; and restarting the heating of the heating member by the heat-generating means during subsequent printing performed in response to the new print request.

With the foregoing configuration of the second temperature controlling method, it is possible to realize a preliminary heating control suitable for an image forming apparatus that includes a removable image heating device without a cover and a cover for the image heating device.

In the second temperature controlling method, it is preferable that the pressing means is in a roller form, and that the method further includes the steps of: independently determining set temperatures of parts of the heating member for heating parts of the material to be heated, which are defined by dividing the material from its leading end with a pitch corresponding to a length of a roller outer periphery of the pressing means, respectively; and controlling the amount of the heat generated by the heat-generating means so that the parts of the heating member have the set temperatures determined in the determining step.

With the foregoing configuration, it is possible to realize a fixing temperature control suitable for an image forming apparatus that includes an a removable image heating device without a cover and a cover for the image heating device.

These and other advantages of the present invention will become apparent to those skilled in the art upon reading and understanding the following detailed description with reference to the accompanying figures.

DETAILED DESCRIPTION OF THE INVENTION

Figure 1:
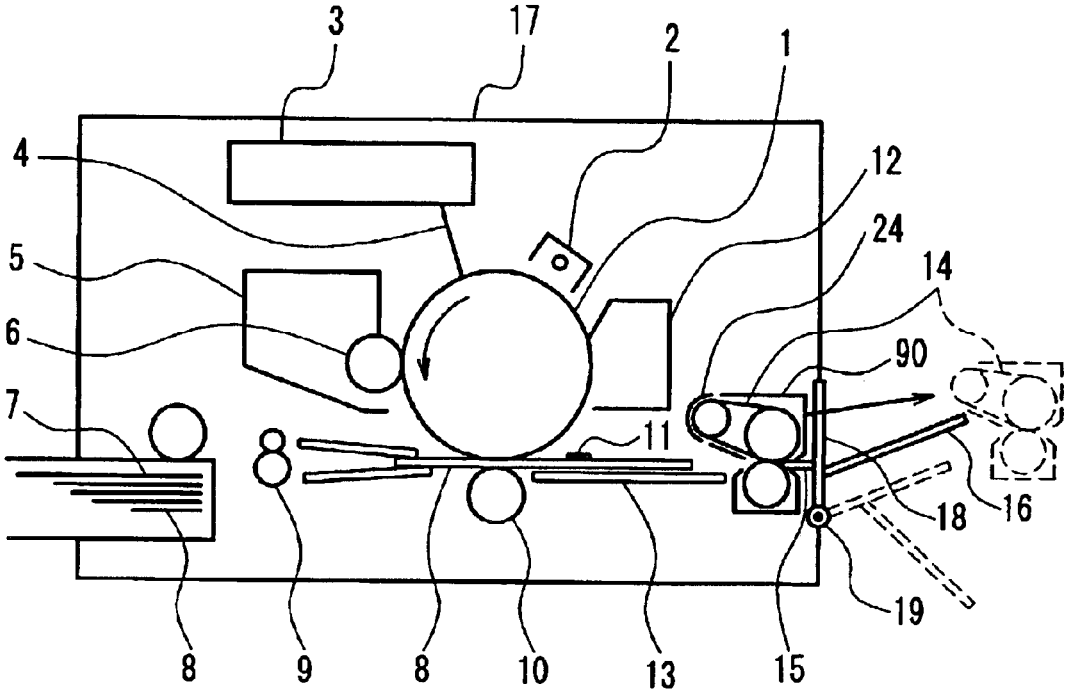
FIG. 1 is a schematic cross-sectional view showing an overall configuration of an image forming apparatus using as a fixing device an image heating device according to a first embodiment of the present invention.

Hereinafter, preferable embodiments of the present invention will be described specifically with reference to the accompanying drawings. In the drawings, the same or corresponding components are referred to with the same numerals, and the explanations thereof will not be repeated.

(First Embodiment)

FIG. 1 is a schematic cross-sectional view showing an overall configuration of an image forming apparatus using as a fixing device an image heating device according to a first embodiment of the present invention. The configuration and operation of this apparatus will be described in the following.

In FIG. 1, numeral 17 denotes an outer shell for the main body of the image forming apparatus, and numeral 1 denotes an electrophotographic photoreceptor (hereinafter referred to as "photosensitive drum"). While this photosensitive drum 1 is rotationally driven at a predetermined peripheral speed in the arrow direction, its surface is charged homogeneously to a predetermined negative dark potential V0 by a charger 2.

Numeral 3 denotes a laser beam scanner, which outputs a laser beam 4 that is modulated in accordance with a time-series electric digital image signal of image information that is input from a host device (not shown in the drawing) such as an image reading apparatus or a computer. The surface of the photosensitive drum 1, which has been charged homogeneously as described above, is scanned and exposed by the laser beam 4, and the absolute potential of the exposed portion of the photosensitive drum 1 is decreased to the light potential VL. Thus, an electrostatic latent image is formed on the surface of the photosensitive drum 1. This electrostatic latent image is then reversely developed with negatively charged toner in a developing device 5 and made manifest.

The developing device 5 includes a developing roller 6, which is driven rotationally. The developing roller 6 is arranged in opposition to the photosensitive drum 1, and a thin layer of toner is formed on an outer peripheral surface of the developing roller 6. A developing bias voltage, whose absolute value is lower than the dark potential V0 and higher than the light potential VL of the photoelectric drum 1, is applied to the developing roller 6. The toner on the developing roller 6 is thus transferred only to the portion of the photosensitive drum 1 with the light potential VL, whereby the electrostatic latent image is made manifest to form a toner image 11.

On the other hand, a recording sheet 8 is fed one by one from a paper-feed portion 7 to a nip portion formed between the photosensitive drum 1 and a transfer roller 10 via a resist roller pair 9 with suitable timing in synchronization with the rotation of the photosensitive drum 1. Then, the toner image 11 on the photosensitive drum 1 is transferred to the recording sheet 8 by the transfer roller 10 to which a transfer bias is applied.

Numeral 13 denotes a paper guide for fixing, which guides the recording sheet 8 onto which the toner image 11 has been transferred to a fixing device 14. After the recording sheet 8 carrying the transferred toner image 11 has separated from the photosensitive drum 1, it is fed into the fixing device 14, which fixes the transferred toner image 11 onto the recording sheet 8. Numeral 15 denotes a paper eject guide, which guides the recording sheet 8 that has passed through the fixing device 14 to the outside of the image forming apparatus. The recording sheet 8 onto which the toner image 11 has been fixed is then ejected to a paper eject tray 16. Numeral 18 denotes a fixing door for allowing attachment/detachment of the fixing device 14 and removal of a paper jam. The fixing door 18 is opened and closed together with the paper eject tray 16 while rotating about a hinge 19. By opening the fixing door 18, it becomes possible to attach/detach the fixing device 14 to/from the image forming apparatus main body in the direction perpendicular to the axis of a heat-generating roller 21 (see FIG. 2). In FIG. 1, the fixing device 14 shown by the dashed line illustrates its position when it is detached from the image forming apparatus main body, whereas the fixing device 14 shown by the solid line illustrates its position when it is attached to the image forming apparatus main body. As shown in FIG. 1, only the fixing device 14 is attached/detached to/from the image forming apparatus main body while leaving magnetization means 24 such as a magnetization coil 25 (see FIG. 2) described later in the image forming apparatus main body.

After the recording sheet 8 has separated from the photosensitive drum 1, the surface of the photosensitive drum 1 is cleaned with a cleaning device 12. The cleaning device 12 removes residual material such as remaining toner so that the photosensitive drum 1 can be used repeatedly for subsequent image formation.

Figure 11:
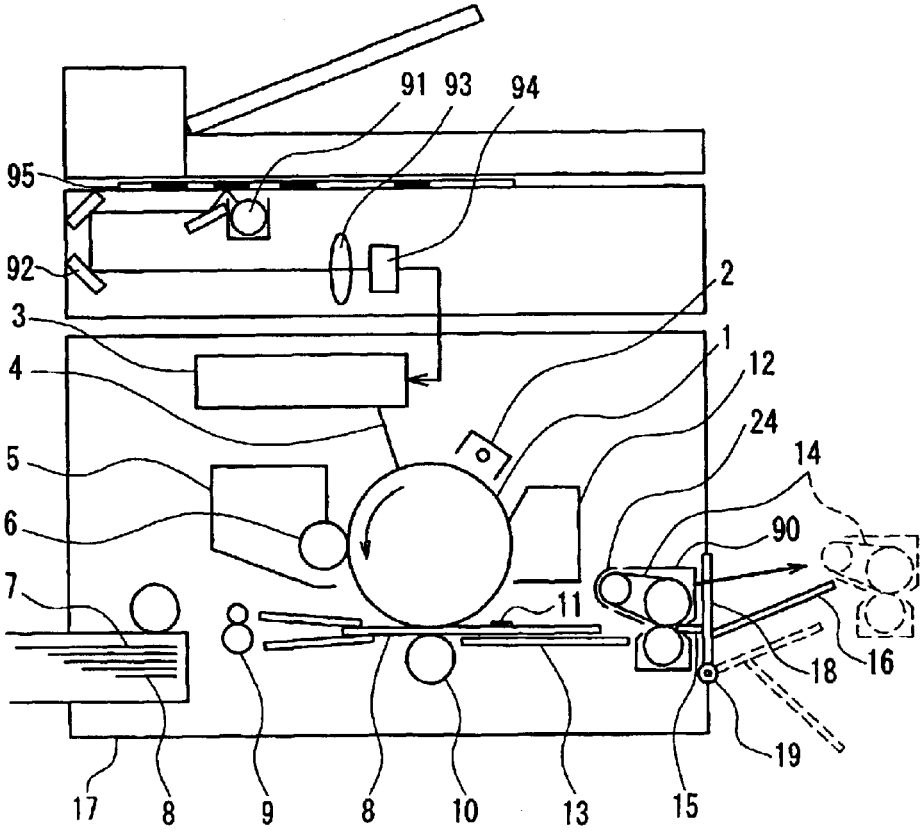
FIG. 11 is a cross-sectional view showing an overall configuration of an image copying machine using the image forming apparatus shown in FIG. 1.

FIG. 11 is a schematic cross-sectional view showing an overall configuration of an image copying machine using the image forming apparatus shown in FIG. 1. In FIG. 11, numeral 91 denotes a light source for exposing an original document 95. Light reflected from a non-image portion of the original document 95 is reflected by a mirror 92 and focused by a lens 93. The image information read by a photoelectric transducer 94 such as CCD is then converted into a time-series electric digital image signal by an A/D converter (not shown in the drawing), for example. After that, the image information is input to the laser beam scanner 3 provided in the image forming apparatus and is used for image formation.

Hereinafter, an image heating device according to the present embodiment will be described more specifically by way of specific examples.

Figure 2:
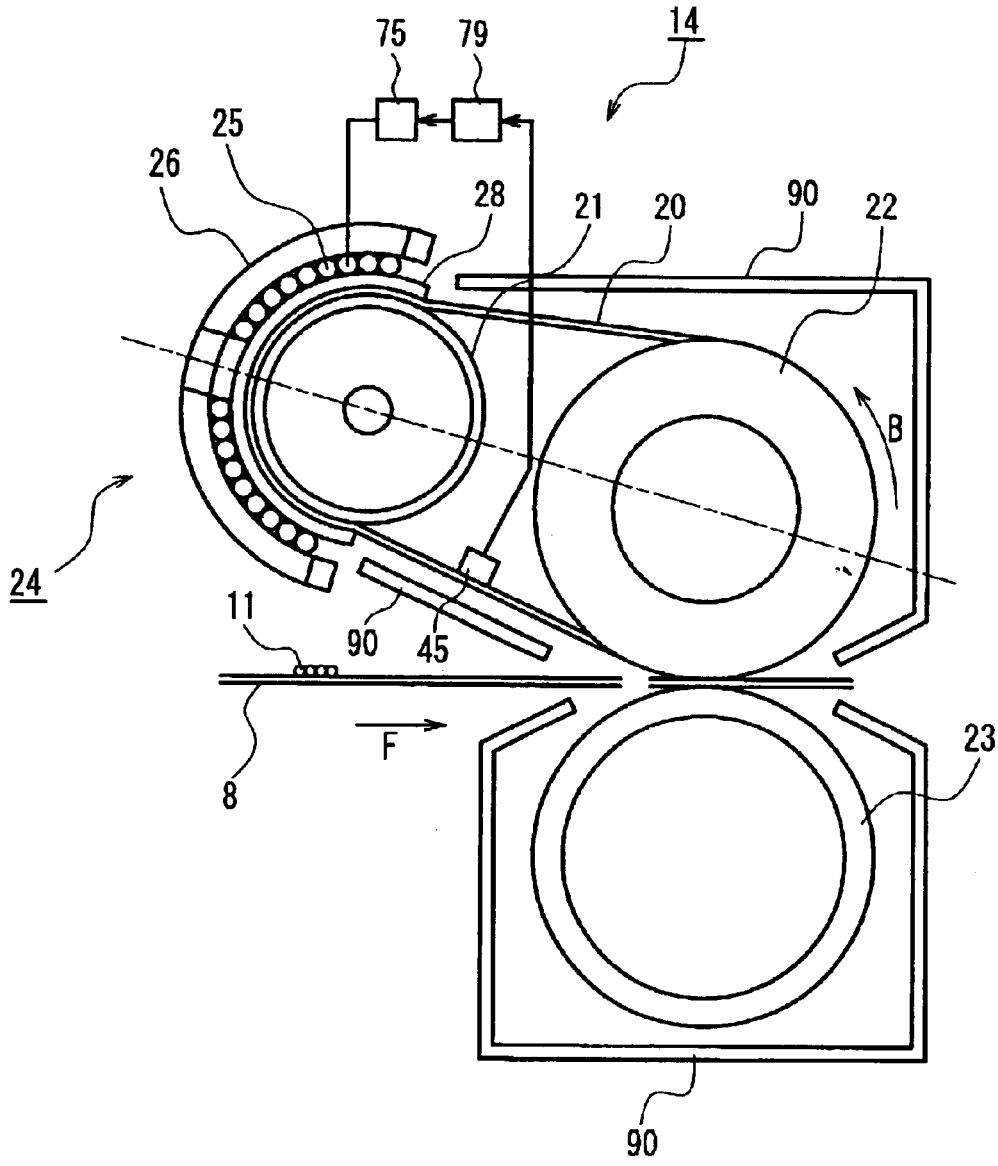
FIG. 2 is a cross-sectional view showing a configuration of the image heating device according to the first embodiment of the present invention.

FIG. 2 is a cross-sectional view showing a fixing device as an image heating device used in the above-described image forming apparatus.

In FIG. 2, numeral 25 denotes a magnetization coil as a part of magnetization means 24. This magnetization coil 25 may be formed using a litz wire of bundled thin wires. The magnetization coil 25 has a cross section in the shape covering a fixing belt 20 looped around the heat-generating roller 21. A core 26 made of ferrite is provided in the center of the magnetization coil 25 as well as in a portion of the rear surface of the magnetization coil 25. For the core 26, a material with high magnetic permeability such as permalloy also can be used in addition to ferrite. The magnetization coil 25 is provided outside the heat-generating roller 21. A magnetizing current of, for example, 23 kHz is applied to the magnetization coil 25 from an exciting circuit 75. Thus, the heat-generating roller 21 partially is heated through electromagnetic induction.

Although the magnetization coil 25 shown in FIG. 2 is provided outside the heat-generating roller 21, the magnetization coil may be provided inside the heat-generating roller.

A temperature sensor 45 is provided so as to be in contact with the rear surface of the fixing belt 20 at the portion past the contact portion in which the fixing belt 20 and the heat-generating roller 21 are in contact with each other. The temperature of the fixing belt 20 thus can be detected by the temperature sensor 45.

Numeral 79 denotes controlling means. The controlling means 79 controls the amount of the heat generated by the heat-generating roller 21 by controlling the electric power to be supplied to the magnetization coil 25 via the exciting circuit 75 on the basis of the temperature of the fixing belt detected by the temperature sensor 45 and a variation with time in the detected temperature so that an optimal fixing temperature is obtained. This controlling method will be described later in detail.

Numeral 28 denotes a coil guide as a supporting member. This coil guide 28 is made of a resin with a superior heat resistance, such as PEEK material or PPS, and is formed in one piece with the magnetization coil 25 and the core 26. The coil guide 28 provided in this manner can prevent the magnetization coil 25 from being damaged due to the heat generated by the heat-generating roller 21 and remaining in the space between the heat-generating roller 21 and the magnetization coil 25.

Although the core 26 shown in FIG. 2 has a semicircular cross section, it is not necessary to form the core 26 in a shape along the magnetization coil 25. For example, the core 26 may have a cross section substantially in the shape of the letter Π (Greek letter "pi" in uppercase).

The thin fixing belt 20 may be an endless belt of 50 mm diameter and 90 $\mu$m thickness, which includes a polyimide resin with a glass transition point of 360° C. as a base. To impart lubrication to the fixing belt 20, the surface of the belt is coated with a lubricant layer (not shown in the drawing) made of a fluorocarbon resin of 30 $\mu$m thickness. For the base, in addition to the polyimide resin used in the present example, other resins with a heat resistance, such as a fluorocarbon resin, also can be used. Preferably, the base of the fixing belt 20 has a glass transition point of 200° C. to 500° C. For the lubricant layer on the surface of the fixing belt 20, a resin or rubber with good lubrication, such as PTFE, PFA, FEP, silicone rubber, or fluorocarbon rubber, may be used alone or in combination. If the fixing belt 20 is used to fix monochrome images, only lubrication has to be ensured. However, if the fixing belt 20 is used to fix color images, it is preferable that the fixing belt 20 has elasticity. In this case, it is necessary to form a thicker rubber layer. The fixing belt 20 preferably has a thermal capacity of not more than 60 J/K, more preferably not more than 40 J/K.

The fixing belt 20 is suspended with a predetermined tensile force between the heat-generating roller 21 and a fixing roller 22 of 20 mm diameter with low thermal conductivity, whose surface may be made of elastic foamed silicone rubber with low hardness (JIS A30 degrees), and is rotationally movable in arrow direction B.

The heat-generating roller 21 may be made of SUS 430 in a cylindrical shape, which is 30 mm in diameter, 320 mm in length, and 0.5 mm in thickness. The thermal capacity of the heat-generating roller 21 is 54 J/K. For the heat-generating roller 21, other than SUS 430, another magnetic metal such as iron also can be used. The thermal capacity of the heat-generating roller 21 preferably is 60 J/K or less, more preferably 40 J/K or less.

The pressure roller 23 may be made of silicone rubber with a hardness of JIS A65 degrees and pressed against the fixing roller 22 via the fixing belt 20, thereby forming a nip portion. In this state, the pressure roller 23 is supported so as to rotate following the fixing roller 22. For the pressure roller 23, a heat-resistant resin or rubber, such as fluorocarbon rubber other than the silicone rubber or a fluorocarbon resin, also may be used. To enhance abrasion resistance and lubrication of the pressure roller 23, it is preferable that the surface of the pressure roller 23 is coated with a resin such as PFA, PTFE, or FEP or rubber alone or in combination. Further, to avoid heat radiation, it is preferable that the pressure roller 23 is made of a material with low thermal conductivity.

The pressure roller 23 is rotationally driven by a driving source (not shown in the drawing) provided in the main body of the image forming apparatus. The fixing roller 22 rotates following the pressure roller 23 via the fixing belt 20. Then, the heat-generating roller 21 rotates following the fixing roller 22 via the fixing belt 20.

Numeral 90 denotes a cover enclosing the space occupied by a part of the fixing belt 20 and heat-generating roller 21 (excluding a portion opposing the magnetization coil 25), the fixing roller 22, the temperature sensor 45, and the pressure roller 23. The cover 90 serves to make the temperature of the fixing belt 20 coincide with the temperature of the atmosphere surrounding the fixing belt 20, thus preventing the temperature of the pressure roller 23 from becoming higher than that of the fixing belt 20. As a result, it becomes possible to estimate the temperature of the pressure roller 23 accurately.

In the fixing device shown in FIG. 2, the fixing belt 20 is suspended between the heat-generating roller 21 and a fixing roller 22. However, the fixing device may have a single-shaft structure in which a tube-like fixing belt is provided on a fixing roller. In this case, the fixing belt also is driven by a pressure roller. The fixing device may be constructed in such a manner that only the tube-like fixing belt is rotated with the fixing roller or a fixing and pressing member being fixed, or the fixing roller and the fixing belt may be rotated at the same time. In this case, a magnetization coil may be provided either outside or inside the loop of the fixing belt.

Figure 8:
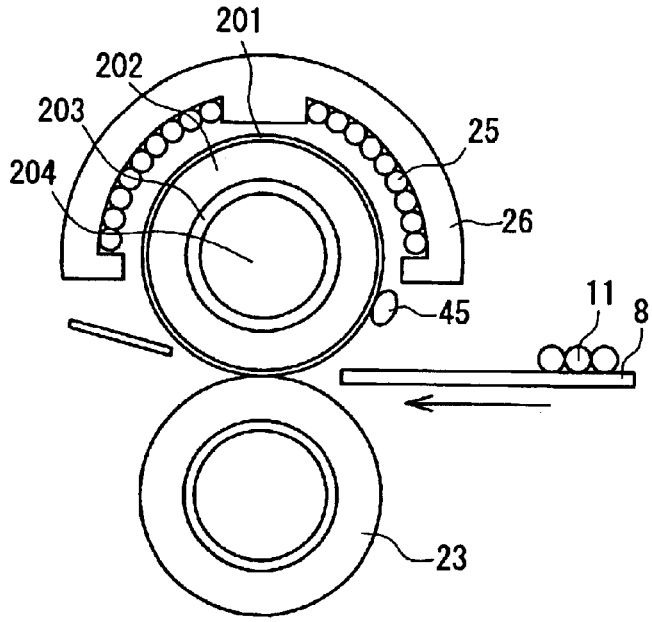
FIG. 8 is a cross-sectional view showing another example of a configuration of the fixing device shown in FIG. 2.
Figure 9:
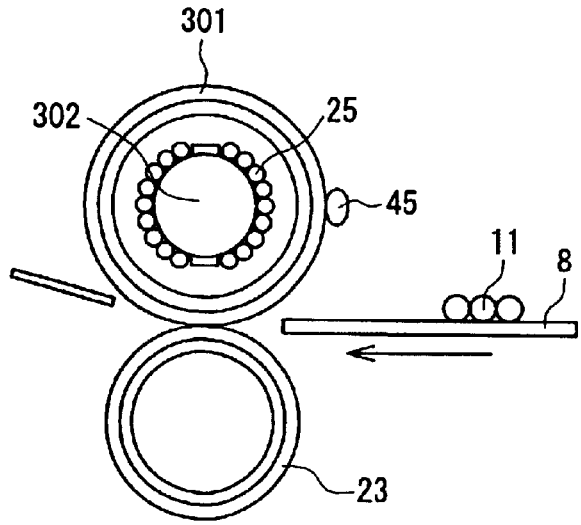
FIG. 9 is a cross-sectional view showing still another example of a configuration of the fixing device shown in FIG. 2.
Figure 10:
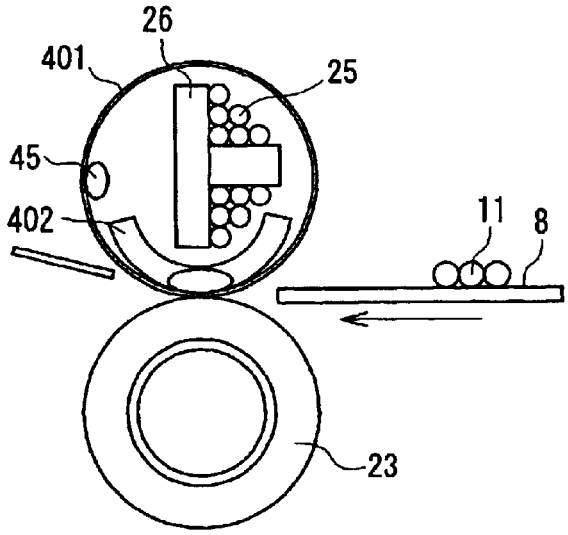
FIG. 10 is a cross-sectional view showing still another example of a configuration of the fixing device shown in FIG. 2.

FIGS. 8, 9, and 10 show an example of a fixing device with a single-shaft structure. In FIGS. 8 to 10, the components having the same configuration and performing the same function as those in FIG. 2 are referred to with the same numerals.

FIG. 8 is a cross-sectional view showing one example of a configuration of a single-shaft fixing device of an outside-coil type.

In FIG. 8, a fixing roller may include a core shaft 204, a magnetic shielding layer 203 formed on the core shaft 204, and a silicone rubber layer 202 made of elastic foamed silicone rubber with low hardness (Asker-C 40 degrees) formed on the magnetic shielding layer 203, and a fixing belt 201 made of metal is provided on the outer surface of the silicone rubber layer 202. The metal fixing belt 201 has the same configuration as that of the fixing belt 20, except that the base of the fixing belt 201 is made of a very thin metal such as nickel fabricated by electroforming.

According to this configuration, an apparent thermal capacity is smaller than that of a fixing device with a dual-shaft structure, and the time required for raising the temperature thus can be shortened. However, since the fixing device is more susceptible, to the influence of the temperature of the pressure roller and the temperature decrease is liable to occur at both ends of the fixing belt, temperature control according to the present invention is necessary.

FIG. 9 is a cross-sectional view showing another example of a configuration of a single-shaft fixing device of an inside-coil type.

In FIG. 9, a fixing roller 301 may be made of SUS 430 in a cylindrical shape, which is 30 mm in diameter, 320 mm in length, and 0.8 mm in thickness. For the fixing roller 301, other than SUS 430, another magnetic metal such as iron also can be used. A magnetization coil 25 is wound around a coil holder 302 made of a heat-resistant resin and heats the fixing roller 301 from the inside of the fixing roller 301.

FIG. 10 is a cross-sectional view showing still another example of a configuration of a single-shaft fixing device of an inside-coil type.

In FIG. 10, a fixing belt 401 is a belt whose base is made of a very thin metal such as nickel fabricated by electroforming. The fixing belt 401 has a lubricant layer formed on its surface via an elastic silicone rubber layer. For the lubricant layer, a resin or rubber with good lubrication, such as PTFE, PFA, FEP, silicone rubber, or fluorocarbon rubber, may be used alone or in combination.

The fixing belt 401 is held between a pressing member 402 and a pressure roller 23, and rotates following the pressure roller 23.

According to this configuration, since the fixing belt 401 has a small thermal capacity, the fixing belt 401 is susceptible to the influence of an ambient temperature and fixing properties thereof are dependent highly on the temperature of the pressure roller. Besides, the temperature decreases considerably at both ends of the fixing belt 401 at the time of low power applications. Accordingly, temperature control according to the present invention can provide a noticeable improvement.

By inserting the recording sheet 8, onto which the toner image 11 has been transferred using the image forming apparatus of FIG. 1, into the fixing device having the above-described configuration in arrow direction F with the side carrying the toner image 11 facing the fixing roller 22 as shown in FIG. 2, the toner image 11 can be fixed on the recording sheet 8.

Next, a method for changing a fixing temperature each time the pressure roller 23 makes one rotation using the above-described image heating device will be described with reference to FIG. 2, as well as FIGS. 3, 4A, 4B, and 4C.

Figure 3:
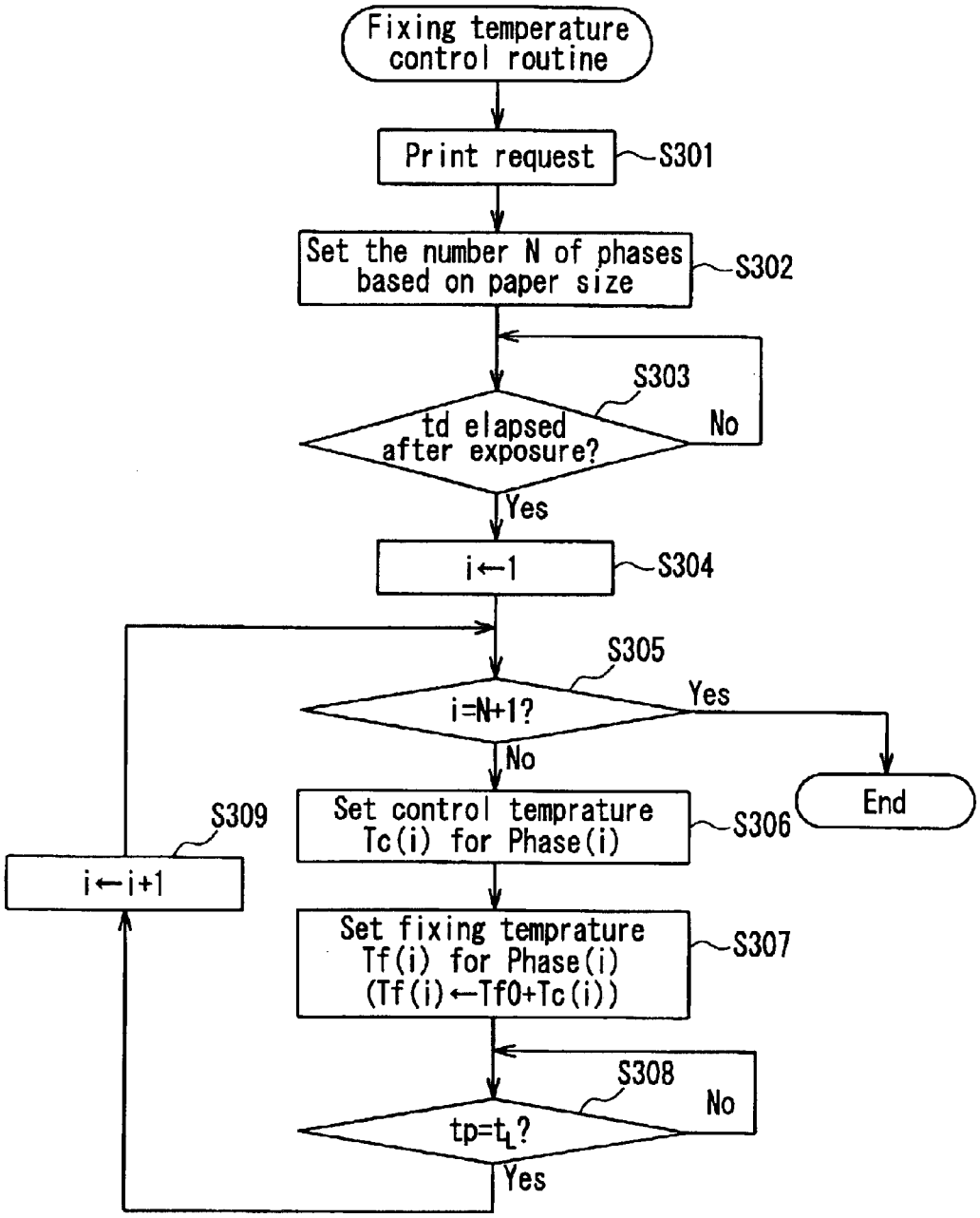
FIG. 3 is a flowchart illustrating a flow of a process for a fixing temperature control routine applied to an image heating device and an image forming apparatus according to the first embodiment of the present invention.

FIG. 3 is a flowchart illustrating a flow of a process for a fixing temperature control routine applied to an image heating device and an image forming apparatus according to the present embodiment.

Figures 4A, 4B, 4C:
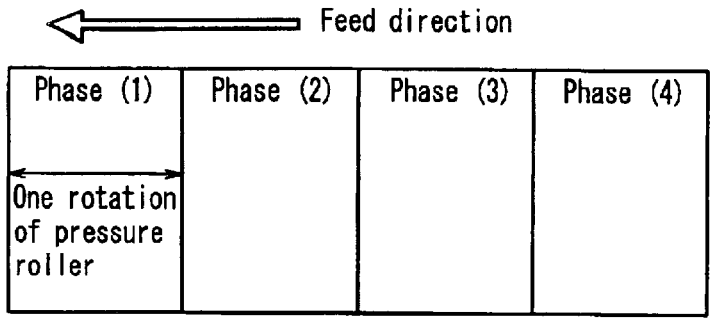
FIG. 4A is a schematic view showing parts (Phase (1) to Phase (4)) of a recording sheet, which are defined by dividing the recording sheet with a pitch corresponding to the length of an outer periphery of a pressure roller.
FIG. 4B shows a length of parts (Phase (1) to Phase (4)) of recording sheets of various sizes, which are defined by dividing recording sheets with a pitch corresponding to the length of an outer periphery of a pressure roller.
FIG. 4C is a view illustrating an example of contents on a look-up table storing a control temperature Tc (i) (i=1 to 4) for parts (Phase (1) to Phase (4)) of a recording sheet, which are defined by dividing the recording sheet with a pitch corresponding to the length of an outer periphery of a pressure roller.

FIG. 4A is a schematic view showing parts (Phase (1) to Phase (4)) of a recording sheet, which are defined by dividing the recording sheet from its leading end in the feed direction with a pitch corresponding to the length of an outer periphery (for example, 94 mm) of a pressure roller.

FIG. 4B shows a length of parts (Phase (1) to Phase (4)) of recording sheets of various sizes, which are defined by dividing the recording sheet from its leading end in the feed direction with a pitch corresponding to the length of an outer periphery (for example, 94 mm) of a pressure roller.

FIG. 4C is a view illustrating an example of contents on a look-up table storing a control temperature for parts (Phase (1) to Phase (4)) of a recording sheet, which are defined by dividing the recording sheet from its leading end in the feed direction with a pitch corresponding to the length of an outer periphery (for example, 94 mm) of a pressure roller.

In FIG. 3, first of all, when a print request is issued by the user (S301), the number of phases N is set based on the selected sheet size (S302). For example, when an A4-size sheet in portrait orientation as shown in FIG. 4B is selected, the number of phases N is set to 4 because the sheet includes all the parts from Phase (1) to Phase (4).

Next, it is determined whether or not a predetermined time td has elapsed after the exposure (S303). This step is performed for the following reason. Considering the time lag between the instant when the fixing belt 20 is separated from the heat-generating roller 21 and the instant when the fixing belt 20 enters the nip portion, it is necessary to change the set temperature when the recording sheet 8 is fed to a point that is upstream from the nip portion by the distance (L) corresponding to the distance between the point where the fixing belt 20 separates from the heat-generating roller 21 and the point where the fixing belt 20 enters the nip portion. For example, when the distance (L) is 71 mm and the process speed is 100 mm/s, the set temperature is changed about 5.4 seconds (predetermined time td) after the exposure.

In the case where it is determined in Step S303 that the predetermined time td has elapsed after the exposure (Yes), the flow goes to Step S304, where a variable i representing a Phase number (1 to 4) is set to 1. Next, it is determined whether or not the variable i is equal to a value obtained by adding 1 to the number of the phases N (S305). Since the current value of the variable i is 1 while N+1 is 5 (No), the flow goes to Step S306, where a control temperature Tc (1) for Phase (1) is set at 0 deg shown in FIG. 4C, and thereafter, a fixing temperature Tf (1) for Phase (1) is set at the value obtained by Tf 0+Tc (1) (S307). Tf 0 denotes an initial value of the fixing temperature (for example, 170° C.).

Next, it is determined whether or not an elapsed time tp counted from the instant when the predetermined time td had elapsed after the exposure has reached the time $t_L$, which is represented by the length of Phase (1) in the feed direction/the process speed (in other words, whether or not Phase (1) is completed) (S308). In the case where it is determined in Step S308 that tp=tL (Yes), the variable i is increased by an increment of 1 to make i=2 (S309), and then, the flow goes back to Step S305.

In Step S305, it is determined whether or not i=N+1. Since the current value of the variable i is 2 while N+1 is 5 (No), the flow goes to Step S306, where a control temperature Tc (2) for Phase (2) is set at 0 deg shown in FIG. 4C, and thereafter, a fixing temperature Tf (2) for Phase (2) is set at the value obtained by Tf 0+Tc (2) (S307).

Next, it is determined in Step S308 whether or not tp=tL. In the case where tp=tL (Yes), the variable i is increased by an increment of 1 to make i=3 (S309), and then, the flow goes back to Step S305.

In Step S305, it is determined whether or not i=N+1. Since the current value of the variable i is 3 while N+1 is 5 (No), the flow goes to Step S306, where a control temperature Tc (3) for Phase (3) is set at 1.5 deg shown in FIG. 4C, and thereafter, a fixing temperature Tf (3) for Phase (3) is set at the value obtained by Tf 0+Tc (3) (S307).

If the variable i becomes 5 in Step S309 after repeating the above-described processes, the flow branches from Step S305 to terminate the routine.

As specifically described above, according to the present embodiment, by making a set fixing temperature higher each time the pressure roller 23 makes one rotation in one recording sheet, the decrease in glossiness occurring from the leading end toward the trailing end of the recording sheet in the feed direction due to the absorption of the heat from the pressure roller 23 by the recording sheet can be prevented.

Although the present embodiment is directed to the configuration in which a set fixing temperature Tf (i) for each Phase is controlled by reading out a control temperature Tc (i) for each Phase stored in the look-up table of FIG. 4C, the present invention is not limited to this configuration. For example, a control temperature Tc (i) for each Phase may be set so as to be variable in a certain range, based on the temperature of the pressure roller 23 estimated from the temperature of the fixing belt 20 detected by the temperature sensor 45 and a variation with time in the detected temperature.

(Second Embodiment)

An image heating device of the second embodiment has the same configuration as that of the image heating device of the first embodiment as shown in FIG. 2. However, the second embodiment is different from the first embodiment in that, while temperature control in the first embodiment is performed to eliminate the irregularity in gloss caused in the recording sheet in the feed direction, temperature control in the second embodiment is performed to eliminate the irregularity in gloss caused in the recording sheet in the axial direction of the pressure roller 23.

Hereinafter, a method for controlling a temperature in a semicontinuous print mode will be described with reference to FIG. 5.

Figure 5:
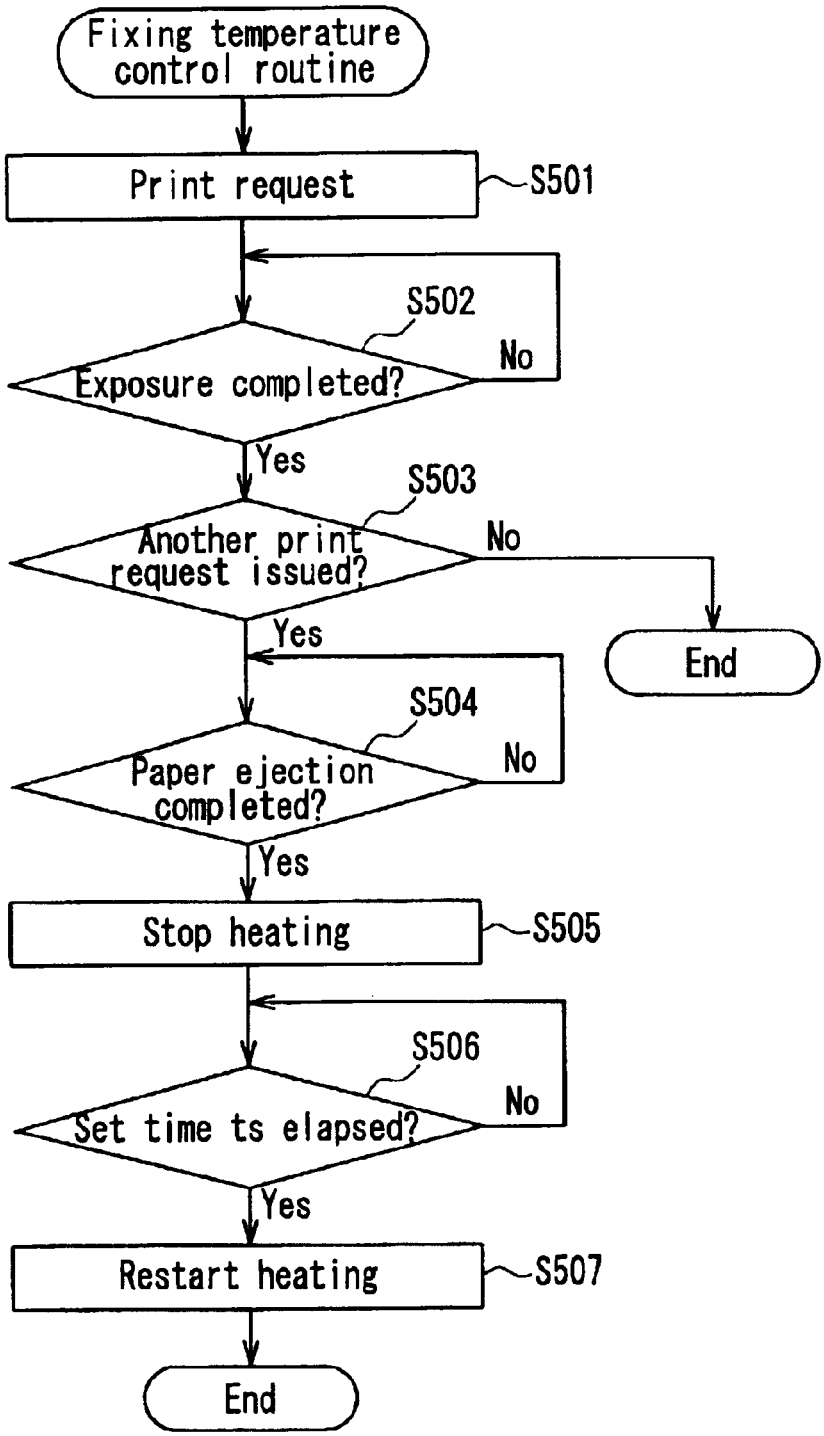
FIG. 5 is a flowchart illustrating a flow of a process for a fixing temperature control routine applied to an image heating device and an image forming apparatus according to a second embodiment of the present invention.

FIG. 5 is a flowchart illustrating a flow of a process for a fixing temperature control routine applied to an image heating device and an image forming apparatus according to the present embodiment.

In FIG. 5, first of all, when a print request is issued by the user (S501), it is determined whether or not the laser exposure in response to the print request is completed (S502). In the case where it is determined in Step S502 that the laser exposure is completed (Yes), it is determined whether or not a new print request is issued by the user (S503). In the case where it is determined in Step S503 that no print request is issued by the user (No), the flow exits from the routine.

On the other hand, in the case where it is determined in Step S503 that a new print request is issued by the user (Yes), it is determined whether or not paper ejection in response to the print request issued previously is completed (S504). In the case where it is determined in Step S504 that paper ejection is completed (Yes), the heating of the fixing belt 20 by the heat-generating roller 21 is stopped while continuing the rotation of the fixing belt 20 (S505), and then, it is determined whether or not a predetermined set time ts (for example, 5 seconds) has elapsed (S506).

In the case where it is determined in Step S506 that the predetermined set time ts has elapsed after the heating of the fixing belt 20 by the heat-generating roller 21 is stopped (Yes), the heating of the fixing belt 20 by the heat-generating roller 21 is restarted (S507).

Figure 7A:
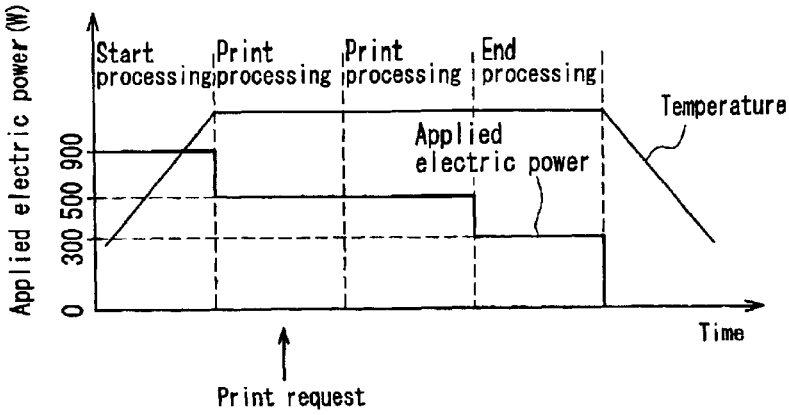
FIG. 7A PRIOR ART
FIG. 7A shows a change in a fixing temperature and an applied electric power with time in a continuous print mode.
Figure 7B:
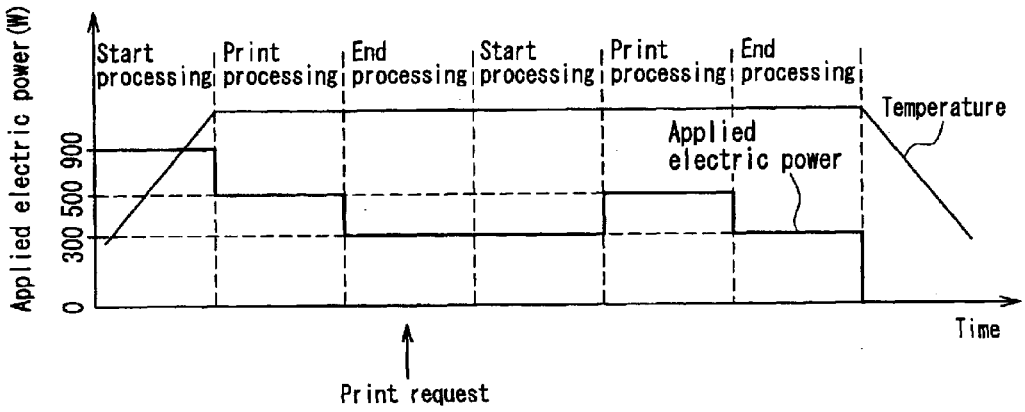
FIG. 7B PRIOR ART
FIG. 7B shows a change in a fixing temperature and an applied electric power with time in a conventional semicontinuous print mode.
Figure 7C:
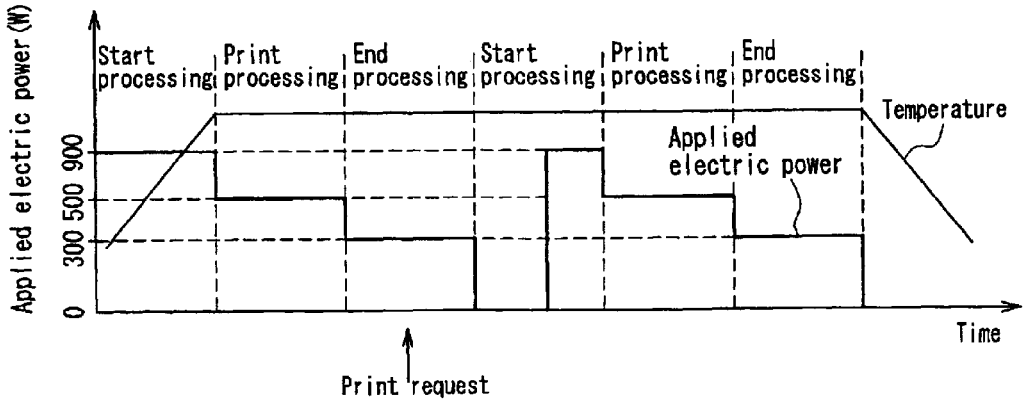
FIG. 7C shows a change in a fixing temperature and an applied electric power with time in a semicontinuous print mode according to the second embodiment of the present invention.

As specifically described above, according to the present embodiment, when a print request is issued during the end-processing sequence, an applied electric power is dropped to 0 during the start-processing sequence, and after an appropriate interval, the heating with full power (900 W) is restarted, as shown in FIG. 7C, thereby compensating the decrease in temperature at both ends of the fixing belt 20 and the heat-generating roller 21 in the axial direction.

(Third Embodiment)

Figure 6:
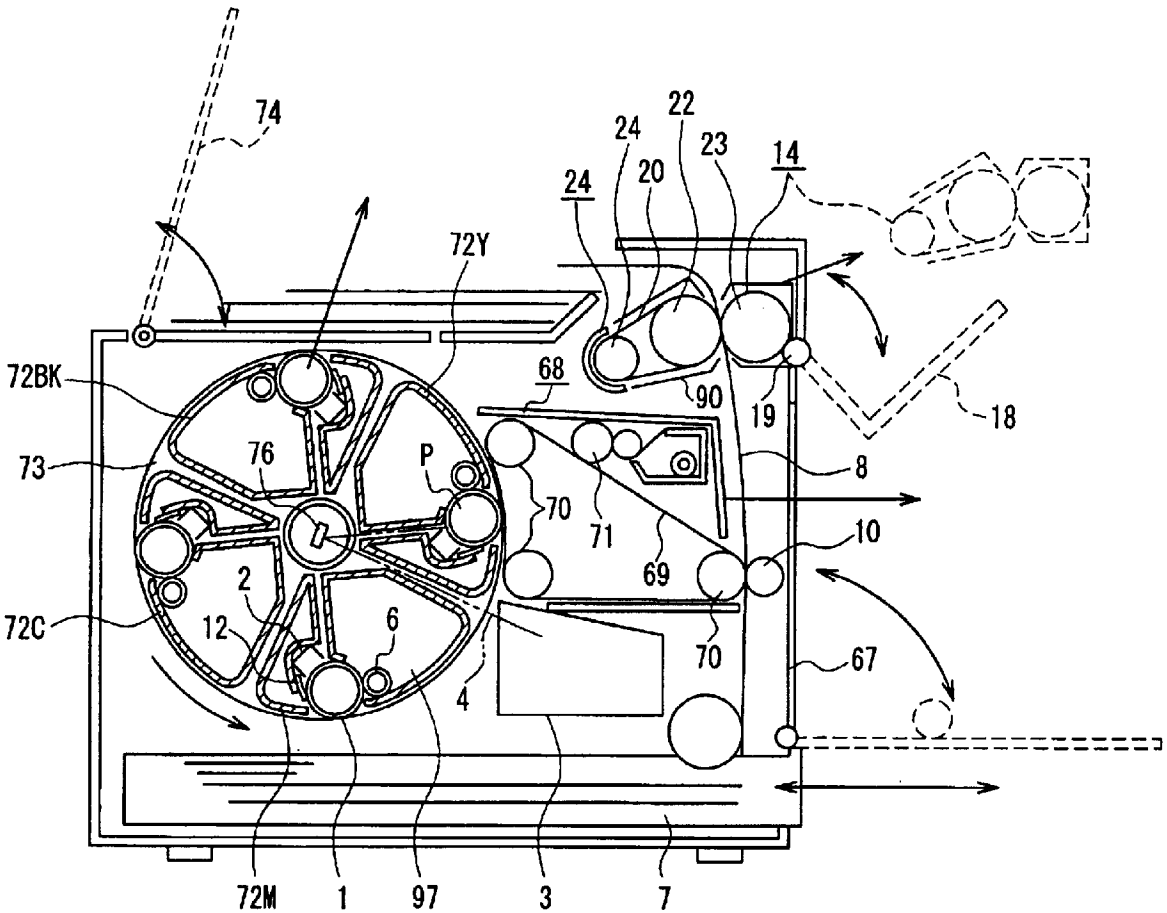
FIG. 6 is a cross-sectional view showing an overall configuration of a color image forming apparatus according to a third embodiment of the present invention, which uses as a fixing device an image heating device according to the first or second embodiment.

FIG. 6 is a cross-sectional view showing an overall configuration of a color image forming apparatus according to a third embodiment of the present invention, which uses as a fixing device an image heating device according to the first or second embodiment.

In FIG. 6, the right-hand face is the front face of the color image forming apparatus, on which a front door 67 is provided. Numeral 68 denotes a transfer belt unit including an intermediate transfer belt 69, three support axes 70 suspending the intermediate transfer belt 69, and a cleaner 71, which are formed in one piece and attached to the color image forming apparatus in a freely attachable and detachable manner. In this case, as shown in FIG. 6, the transfer belt unit 68 can be attached/detached to/from the color image forming apparatus after opening the front door 67.

On the left side of the interior of the color image forming apparatus, a carriage 73 is provided adjacent to the transfer belt unit 68. The carriage 73 may contain four annularly arranged image forming units 72BK, 72C, 72M, and 72Y for four colors, i.e., black (BK), cyan (C), magenta (M), and yellow (Y), respectively, each having a cross section of substantially wedge shape. The carriage 73 is rotatable in the arrow direction.

The image forming unit 72, which is formed in one piece with a photosensitive drum 1 and process elements arranged around the drum, includes the following components.

Numeral 2 denotes a corona charger for charging the photosensitive drum 1 with a homogeneous negative charge, numeral 97 denotes developing devices containing black toner, cyan toner, magenta toner, and yellow toner, respectively, for forming toner images of respective colors by supplying negatively charged toner from developing rollers 6 to an electrostatic latent image formed on the opposing photosensitive drum 1. In FIG. 6, numeral 3 denotes a laser beam scanner provided beneath the transfer belt unit 68.

The image forming units 72BK to 72Y can be attached/detached to/from the color image forming apparatus by opening a top door 74 on a top face of the color image forming apparatus. When the carriage 73 rotates, the image forming units 72BK, 72C, 72M, and 72Y rotate around a fixed mirror 76. During image formation, the image forming units 72BK, 72C, 72M, and 72Y are shifted sequentially to the image forming position P opposing the intermediate transfer belt 69.

An operation of the color image forming apparatus configured as above will be described in the following.

First, the carriage 73 is rotated to shift the image forming unit 72Y for the first color yellow to the image forming position P (a state illustrated in FIG. 6). In this state, a laser beam 4 emitted from the laser beam scanner 3 passes through the portion between the image forming units 72Y and the image forming units 72M for magenta and is then reflected by the mirror 76 to enter the photosensitive drum 1 that is at the image forming position P. Thus, an electrostatic latent image is formed on the photosensitive drum 1. This electrostatic latent image is developed by yellow toner conveyed to the developing roller 6 of the developing device 97 opposing the photosensitive drum 1, thereby forming a toner image on the photosensitive drum 1. Subsequently, the yellow toner image formed on the photosensitive dram 1 is transferred (which is a primary transfer) to the intermediate transfer belt 69.

After the formation of the yellow toner image is completed, the carriage 73 is rotated 90° in the arrow direction to shift the image forming unit 72M for magenta to the image forming position P. Then, an image forming operation is performed in the same manner as for yellow, thereby forming a magenta toner image so as to overlap the yellow toner image on the intermediate transfer belt 69. The same image forming operations are repeated for cyan and black in this order, so that a toner image including the toner images of four colors overlapped with each other are formed on the intermediate transfer belt 69.

The transfer roller 10 is brought into contact with the intermediate transfer belt 69 in synchronization with the top position of the forth black toner image on the intermediate transfer belt 69 comes. Subsequently, a recording sheet 8 is fed to the nip portion formed between the transfer roller 10 and the intermediate transfer belt 69, thereby transferring (which is a secondary transfer) the toner image of four colors onto the recording sheet 8. The recording sheet 8 onto which the toner image has been transferred passes through the fixing device 14 to fix the toner image thereon and then is ejected to the outside of the color image forming apparatus. Toner remaining on the intermediate transfer belt 69 after the secondary transfer is removed by the cleaner 71, which separates from and contacts with the intermediate transfer belt 69 with suitable timing.

After image formation on a sheet of paper is completed, the image forming unit 72Y for yellow is shifted to the image forming position P, thus completing the preparation for subsequent image formation.

In the present embodiment, the fixing belt 20 may include a polyimide resin of 90 $\mu$m thickness as a base, onto which silicone rubber of 150 $\mu$m thickness is laminated. The fixing belt 20 is tensioned in the direction in which the fixing device 14 is attached/detached to/from the color image forming apparatus main body.

As shown in FIG. 6, in the fixing device 14, the heat-generating roller 21, the fixing roller 22, and the pressure roller 23 can be attached/detached to/from the color image forming apparatus main body as one unit while leaving the magnetization means 24 in the image forming apparatus main body. The direction in which the fixing belt 20 is tensioned and the direction in which the opening of the magnetization means 24 with a semicircular cross section is opened coincide with the direction in which the fixing device 14 is attached/detached to/from the color image forming apparatus main body. As a result, the magnetization means 24 and the heat-generating roller 21 do not interfere with each other, which allows easy attachment/detachment of the fixing device 14. The attachment/detachment of the fixing device 14 can be performed by opening/closing a fixing door 18.

Although the above-described respective embodiments are directed to the configuration in which the heat-generating roller 21 generates heat through electromagnetic induction, thereby indirectly heating the fixing belt 20, the present invention is not limited to this configuration. For example, it is also possible to use a conductive fixing belt 20 and heat the conductive fixing belt 20 directly through electromagnetic induction. In this case, the conductive fixing belt 20 may be a belt including a belt base fabricated by electroforming with nickel, which is 30 $\mu$m in thickness and 60 mm in diameter, onto which silicone rubber of 150 $\mu$m thickness has been formed for fixing color images, for example.

The above-described respective embodiments are directed to the case where the cover 90 for making the temperature of the fixing belt 20 detected by the temperature sensor 45 coincide with the temperature of the atmosphere in the vicinity of the temperature sensor 45 is attached to the image heating device. However, the cover 90 may be attached to the image forming apparatus in the state where the image heating device is detached therefrom so that the cover 90 encloses the space occupied by the fixing belt 20, the temperature sensor 45, and the pressure roller 23 when the image heating device is attached to the image forming apparatus.

As specifically described above, according to the present invention, it becomes possible to eliminate the difference in glossiness caused in a recording medium in the feed direction and the axial direction of a pressure roller.

The invention may be embodied in other forms without departing from the spirit or essential characteristics thereof.

The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An image heating device comprising:

a movable heating member for directly heating a material to be heated;

heat-generating means for directly or indirectly heating the heating member;

pressing means arranged in contact with the heating member;

a temperature sensor for detecting a temperature of the heating member; and controlling means for controlling an amount of heat generated by the heat-generating means according to the temperature of the heating member detected by the temperature sensor so that the heating member has a set temperature, wherein, when a new print request is issued while an earlier print request has not finished a printing process, the controlling means stops the heating of the heating member by the heat-generating means after starting the processing of the printing that is performed in response to the new print request and restarts the heating of the heating member by the heat-generating means during the processing of the new print request.

2. The image heating device according to claim 1, wherein the heating member is at least partially conductive, and the heat-generating means includes magnetization means that directly heats the heating member through electromagnetic induction.

3. The image heating device according to claim 1, wherein the heat-generating means includes:

a rotatable heat-generating member for indirectly heating the heating member, the heat-generating member being at least partially conductive and arranged in contact with an inner peripheral surface of the heating member; and magnetization means that heats the heating member through electromagnetic induction.

4. The image heating device according to claim 1, wherein the heating member is in a belt form.

5. The image heating device according to claim 1, wherein the heating member has a thermal capacity of not more than 60 J/K.

6. The image heating device according to claim 1, wherein the heating member has a thermal capacity of not more than 40 J/K.

7. The image heating device according to claim 1, wherein the controlling means stops the heating of the heating member by the heat-generating means for a while also when a new print request is issued within a predetermined period after completion of printing and restarts the heating of the heating member by the heat-generating means during subsequent printing performed in response to the new print request.

8. The image heating device according to claim 1, further comprising a cover for covering a space occupied by at least a part of the heating member, the temperature sensor, and the pressing means excluding a path portion through which the material to be heated passes, so as to make the temperature of the heating member detected by the temperature sensor substantially coincide with an ambient temperature in the vicinity of the temperature sensor.

9. The image heating device according to claim 1, wherein the pressing means is in a roller form, and the controlling means independently determines set temperatures of parts of the heating member for heating parts of the material to be heated, which are defined by dividing the material from its leading end with a pitch corresponding to a length of a roller outer periphery of the pressing means, respectively.

10. The image heating device according to claim 9, wherein the controlling means determines the set temperatures of the parts of the heating member based on a temperature of the pressing means.

11. The image heating device according to claim 10, wherein the temperature of the pressing means is estimated according to at least one of a temperature of the heating member detected by the temperature sensor and a variation with time in the detected temperature.

12. An image forming apparatus comprising:

image forming means for forming an unfixed toner image onto a recording medium as an material to be heated and having the unfixed image carried thereon; and a fixing device for thermally fixing the toner image onto the recording medium, the fixing device including:

a movable heating member for directly heating the material to be heated;

heat-generating means for directly or indirectly heating the heating member;

pressing means arranged in contact with the heating member;

a temperature sensor for detecting a temperature of the heating member; and controlling means for controlling an amount of heat generated by the heat-generating means according to the temperature detected by the temperature sensor so that the heating member has a set temperature, wherein, when a new print request is issued while an earlier print request has not finished a printing process, the controlling means stops the heating of the heating member by the heat-generating means after starting the processing of the printing that is performed in response to the new print request and restarts the heating of the heating member by the heat-generating means during the processing of the new print request.

13. An image forming apparatus comprising:

image forming means for forming an unfixed toner image onto a recording medium as a material to be heated and having the unfixed image carried thereon;

a removable fixing device for thermally fixing the toner image onto the recording medium, the fixing device including:

a movable heating member for directly heating the material to be heated;

heat-generating means for directly or indirectly heating the heating member;

pressing means arranged in contact with the heating member;

a temperature sensor for detecting a temperature of the heating member; and controlling means for controlling an amount of heat generated by the heat-generating means according to the temperature detected by the temperature sensor so that the heating member has a set temperature, wherein, when a new print request is issued while an earlier print request has not finished a printing process, the controlling means stops the heating of the heating member by the heat-generating means after starting the processing of the printing that is performed in response to the new print request and restarts the heating of the heating member by the heat-generating means during the processing of the new print request; and a cover for covering a space occupied by at least a part of the heating member, the temperature sensor, and the pressing means excluding a path portion through which the material to be heated passes when the fixing device is attached, so as to make the temperature of the heating member detected by the temperature sensor substantially coincide with an ambient temperature in the vicinity of the temperature sensor.

14. An image copying machine comprising an image forming apparatus, wherein the image forming apparatus includes:

an image reading apparatus including image reading means for reading an original image; and an image forming apparatus, the image forming apparatus including:

image forming means for forming an unfixed toner image according to the original image read by the image reading apparatus onto a recording medium as a material to be heated, and having the unfixed image carried thereon; and a fixing device for thermally fixing the toner image on the recording medium, the fixing device including:

a movable heating member for directly heating the material to be heated;

heat-generating means for directly or indirectly heating the heating member;

pressing means arranged in contact with the heating member;

a temperature sensor for detecting a temperature of the heating member; and controlling means for controlling an amount of heat generated by the heat-generating means according to the temperature detected by the temperature sensor so that the heating member has a set temperature, wherein, when a new print request is issued while an earlier print request has not finished a printing process, the controlling means stops the heating of the heating member by the heat-generating means after starting the processing of the printing that is performed in response to the new print request and restarts the heating of the heating member by the heat-generating means during the processing of the new print request.

15. An image copying machine comprising an image forming apparatus, wherein the image forming apparatus includes:

an image reading apparatus including image reading means for reading an original image; and an image forming apparatus, the image forming apparatus including:

image forming means for forming an unfixed toner image according to the original image read by the image reading apparatus onto a recording medium as a material to be heated, and having the unfixed image carried thereon; and a removable fixing device for thermally fixing the toner image on the recording medium, the fixing device including:

a movable heating member for directly heating the material to be heated;

heat-generating means for directly or indirectly heating the heating member;

pressing means arranged in contact with the heating member;

a temperature sensor for detecting a temperature of the heating member; and controlling means for controlling an amount of heat generated by the heat-generating means according to the temperature detected by the temperature sensor so that the heating member has a set temperature, wherein, when a new print request is issued while an earlier print request has not finished a printing process, the controlling means stops the heating of the heating member by the heat-generating means after starting the processing of the printing that is performed in response to the new print request and restarts the heating of the heating member by the heat-generating means during the processing of the new print request; and a cover for covering a space occupied by at least a part of the heating member, the temperature sensor, and the pressing means excluding a path portion through which the material to be heated passes when the fixing device is attached, so as to make the temperature of the heating member detected by the temperature sensor substantially coincide with an ambient temperature in the vicinity of the temperature sensor.

16. A temperature controlling method applicable to an image heating device, the image heating device including:

a movable heating member for directly heating the material to be heated;

heat-generating means for directly or indirectly heating the heating member;

pressing means arranged in contact with the heating member;

a temperature sensor for detecting a temperature of the heating member;

controlling means for controlling an amount of heat generated by the heat-generating means according to the temperature detected by the temperature sensor so that the heating member has a set temperature; and a cover for covering a space occupied by at least a part of the heating member, the temperature sensor, and the pressing means excluding a path portion through which the material to be heated passes, so as to make the temperature of the heating member detected by the temperature sensor substantially coincide with an ambient temperature in the vicinity of the temperature sensor, the method comprising the steps of:

stopping, when a new print request is issued while an earlier print request has not finished a printing process, the heating of the heating member by the heat-generating means after starting the processing of the printing that is performed in response to the new print request; and restarting the heating of the heating member by the heat-generating means during the processing of the new print request.

17. The temperature controlling method according to claim 16, wherein the pressing means is in a roller form, and the method further comprises the steps of:

independently determining set temperatures of parts of the heating member for heating parts of the material to be heated, which are defined by dividing the material from its leading end with a pitch corresponding to a length of a roller outer periphery of the pressing means, respectively; and controlling the amount of the heat generated by the heat-generating means so that the parts of the heating member have the set temperatures determined in the determining step.

18. A temperature controlling method applicable to an image forming apparatus, the image forming apparatus including:

image forming means for forming an unfixed toner image onto a recording medium as a material to be heated and having the unfixed image carried thereon;

a removable image heating device for thermally fixing the toner image onto the recording medium, the image heating device including:

a movable heating member for directly heating the material to be heated;

heat-generating means for directly or indirectly heating the heating member;

pressing means arranged in contact with the heating member;

a temperature sensor for detecting a temperature of the heating member; and controlling means for controlling an amount of heat generated by the heat-generating means according to the temperature detected by the temperature sensor so that the heating member has a set temperature; and a cover for covering a space occupied by at least a part of the heating member, the temperature sensor, and the pressing means excluding a path portion through which the material to be heated passes when the fixing device is attached, so as to make the temperature of the heating member detected by the temperature sensor substantially coincide with an ambient temperature in the vicinity of the temperature sensor, the method comprising the steps of:

stopping, when a new print request is issued while an earlier print request has not finished a printing process, the heating of the heating member by the heat-generating means after starting the processing of the printing that is performed in response to the new print request; and restarting the heating of the heating member by the heat-generating means during the processing of the new print request.

19. The temperature controlling method according to claim 18, wherein the pressing means is in a roller form, and the method further comprises the steps of:

independently determining set temperatures of parts of the heating member for heating parts of the material to be heated, which are defined by dividing the material from its leading end with a pitch corresponding to a length of a roller outer periphery of the pressing means, respectively; and controlling the amount of the heat generated by the heat-generating means so that the parts of the heating member have the set temperatures determined in the determining step.

20. An image heating device comprising:

a movable heating member for directly heating a material to be heated;

heat-generating means for directly or indirectly heating the heating member;

pressing means arranged in contact with the heating member, the pressing means being a type of roller;

a temperature sensor for detecting a temperature of the heating member;

controlling means for controlling an amount of heat generated by the heat-generating means according to the temperature of the heating member detected by the temperature sensor so that the heating member has a set temperature, wherein the controlling means independently determines set temperatures of parts of the heating member for heating parts of the material to be heated, which are defined by dividing the material from its leading end with a pitch corresponding to a length of a roller outer periphery of the pressing means.

* * * * *